US008422906B2

(12) United States Patent
Komiyama et al.

(10) Patent No.: US 8,422,906 B2
(45) Date of Patent: Apr. 16, 2013

(54) IMAGE FORMATION DEVICE

(75) Inventors: Tsutomu Komiyama, Ebina (JP); Masaaki Takahashi, Ebina (JP); Kazuyuki Kouda, Yokohama (JP); Kazutoshi Sugitani, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 12/966,497

(22) Filed: Dec. 13, 2010

(65) Prior Publication Data

US 2011/0142486 A1 Jun. 16, 2011

(30) Foreign Application Priority Data

Dec. 14, 2009 (JP) ..... 2009-282402

(51) Int. Cl.
*G03G 21/20* (2006.01)
*G03G 15/16* (2006.01)

(52) U.S. Cl.
USPC ..... 399/93; 399/101

(58) Field of Classification Search ..... 399/92, 399/93, 98, 99, 101, 121, 123, 400
See application file for complete search history.

(56) References Cited

U.S. PATENT DOCUMENTS 7,991,318 B2 * 8/2011 Tamura et al. ..... 399/92
2005/0031370 A1 * 2/2005 Koshimura et al. ..... 399/99

FOREIGN PATENT DOCUMENTS

JP 2001-188424 A 7/2001

* cited by examiner

*Primary Examiner* — David Gray
*Assistant Examiner* — Sevan A Aydin
(74) *Attorney, Agent, or Firm* — Sughrue Mion, PLLC

(57) ABSTRACT

An image formation device includes an image carrier that holds developed images, a transfer body that transfers the developed images held by the image carrier to a recording medium, a cleaning unit that cleans developer on the transfer body, a developer container in which the developer removed by the cleaning unit is deposited, and a sucking unit that sucks the developer leaking from the developer container, the transfer body having at least a rotating member of which both ends are rotatably supported, and the sucking unit having a suction hole opening at least at one end of the rotating member.

17 Claims, 8 Drawing Sheets

IMAGE FORMATION DEVICE

CROSS-REFERENCE TO RELATED APPLICATIONS

This application is based on and claims priority under 35 USC 119 from Japanese Patent Application No. 2009-282402 filed Dec. 14, 2009.

BACKGROUND

1. Technical Field

The present invention relates to an image formation device.

2. Summary

According to an aspect of the invention, there is provided an image formation device including an image carrier that hold developed images, a transfer body that transfers the developed images held by the image carrier to a recording medium, a cleaning unit that cleans developer on the transfer body, a developer container in which the developer removed by the cleaning unit is deposited, and a sucking unit that sucks the developer leaking from the developer container, the transfer body having at least a rotating member of which both ends are rotatably supported, and the sucking unit having a suction hole opening at least at one end of the rotating member.

BRIEF DESCRIPTION OF THE DRAWINGS

Exemplary embodiments of the present invention will be described in detail based on the following figures, wherein.

DETAILED DESCRIPTION

[First Exemplary Embodiment]

Exemplary embodiments of the present invention will be described with reference to the accompanying drawings.

Figure 1:
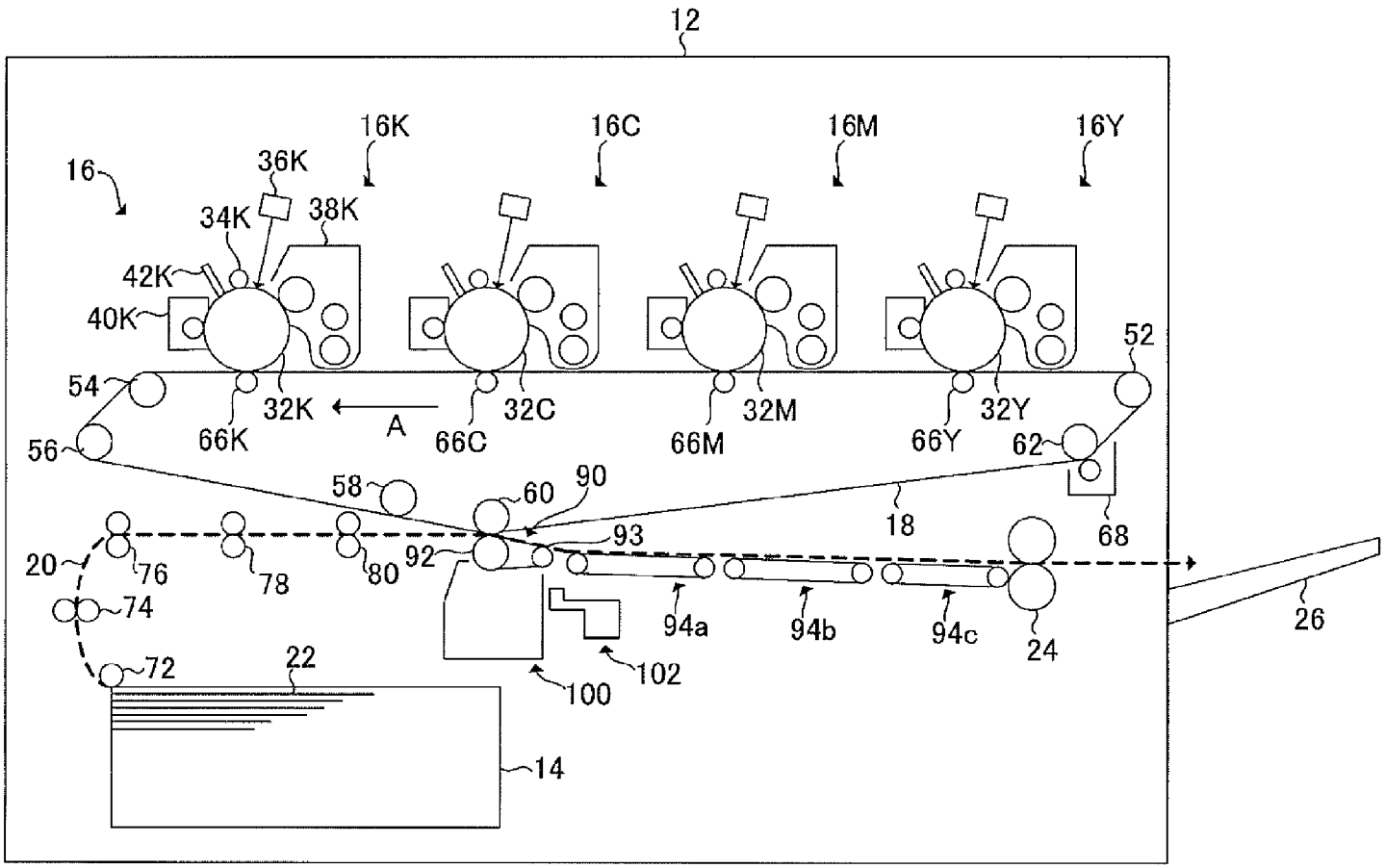
FIG. 1 is a profile of the overall configuration of an image formation device 10 to which one exemplary embodiment of the invention is to be applied.

FIG. 1 shows the overall configuration of an image formation device 10 pertaining to one exemplary embodiment of the invention. The image formation device 10 has an image formation device main body 12, and a paper feed tray 14 is arranged in the lower part of this image formation device main body 12. Further, an original copy reader (not shown) is arranged in the upper part of the image formation device main body 12.

In the upper part of the image formation device main body 12, multiple image formation units 16 are disposed, each corresponding to one of colors constituting color images. In this exemplary embodiment, image formation units 16K, 16Y, 16M and 16C respectively corresponding to black (K), yellow (Y), magenta (M) and cyan (C) are horizontally arrayed along an intermediate transfer belt 18 at regular intervals. The intermediate transfer belt 18 turns in the direction of arrow A in the drawing, and the four image formation units 16K, 16Y, 16M and 16C successively form toner images of the respective colors on the basis of image data inputted from an image processing device (not shown), and these multiple toner images are transferred to the intermediate transfer belt 18 (first transfer) at the timing of these toner images becoming superposed over another. Incidentally, the order of the image formation units 16K, 16Y, 16M and 16C is not limited to that of black (K), yellow (Y), magenta (M) and cyan (C), but may be in any other desired sequence.

Underneath the intermediate transfer belt 18, a recording medium carriage path 20 is arranged. A recording medium 22 fed from the paper feed tray 14 is carried over this recording medium carriage path 20, and the toner images of different colors are transferred onto the intermediate transfer belt 18 in a multiple state and transferred together onto the recording medium 22 (second transfer). The transferred toner images are fixed by a fixing device 24, and the paper sheet bearing the images is ejected onto a paper ejection tray 26.

Next, constituent elements of the image formation device 10 will be described in detail.

Since the image formation units 16K, 16Y, 16M and 16C are similarly configured except for the corresponding colors, the following description will refer only to the image formation unit 16K as representative of all.

The image formation unit 16K includes an image carrier 32K, an electrifier 34K that uniformly electrifies the surface of this image carrier 32K, an exposing device 36K that scans the image carrier 32K with a laser beam to form an electrostatic latent image thereon, a developing device 38K that develops the electrostatic latent image formed on the image carrier 32K, a cleaning device 40K and an antistatic device 42K.

The image carrier 32K is uniformly electrified by the electrifier 34K, and a laser beam irradiated by the exposing device 36K causes an electrostatic latent image to be formed thereon. The electrostatic latent image formed on the image carrier 32K is developed by the developing device 38K with a black (K) toner and is transferred to the intermediate transfer belt 18 (first transfer). After residual toner, paper powder and the like having stuck to the image carrier 32K are removed by the cleaning device 40K, the image carrier 32K is cleared of electrostatic charge by the antistatic device 42K.

The other image formation units 16Y, 16M and 16C similarly form toner images of respectively yellow (Y), magenta (M) and cyan (C) in color, and transfer the toner images of these colors so formed to the intermediate transfer belt 18 (first transfer).

The intermediate transfer belt 18 is threaded round a driving roller 52, a first idle roller 54, a steering roller 56, a second idle roller 58, a backup idle roller 60 and a third idle roller 62 in a fixed tension. The rotational driving of the driving roller 52 by a driving motor (not shown) drives the intermediate transfer belt 18 in a circulatory motion at a prescribed speed.

The intermediate transfer belt 18 is made by forming a flexible film of polyimide or some other synthetic resin in a belt shape and connecting the synthetic resin film belt so formed by welding or otherwise into an endless belt.

In the positions respectively opposing the image formation units 16K, 16Y, 16M and 16C within the intermediate transfer belt 18, first transfer rollers 66K, 66Y, 66M and 66C are disposed, and the toner images of the respectively corresponding colors formed on the image carriers 32K, 32Y, 32M and 32C are transferred in a multiple state onto the intermediate transfer belt 18 by the first transfer rollers 66K, 66Y, 66M and 66C. Any residual toner stuck to the intermediate transfer belt 18 is removed by a cleaning device 68 disposed downstream of the second transferring position.

On the recording medium carriage path 20, a paper feed roller 72 that takes the recording medium 22 out of the paper feed tray 14, a first carrying roller pair 74, a second carrying roller pair 76, a third carrying roller pair 78 and a registration roller 80 that carries the recording medium 22 at a prescribed timing to the second transferring position are arranged.

A second transfer belt 90 is disposed in the second transferring position on the recording medium carriage path 20. The second transfer belt 90 is supported by a second transfer roller 92 and a driven roller 93. The second transfer belt 90 is driven in a circulatory motion at a prescribed speed by the rotational driving of the second transfer roller 92 by a driving roller (not shown).

The second transfer roller 92 is arranged in pressure contact with the backup idle roller 60 with the second transfer belt 90 in-between, and this pressure contact force of the second transfer roller 92 and an electrostatic force cause the toner images in different colors transferred in a multiple state onto the intermediate transfer belt 18 to be transferred onto the recording medium carried over the second transfer belt 90 (second transfer). The recording medium 22 onto which the toner images in different colors have been transferred (second transfer) is carried from the second transfer belt 90 to a first conveyor belt 94*a* and then to the fixing device 24 by a second conveyor belt 94*b* and a third conveyor belt 94*c*. The fixing device 24 subjects the recording medium 22, onto which the toner images in different colors have been transferred (second transfer), to heating and pressuring to melt the toners and fix them to the recording medium 22.

The second transfer belt 90 is provided with a second transfer cleaning device 100 that removes residual toners having stuck to this second transfer belt 90. A sucking device 102 is further disposed in the vicinities of the second transfer cleaning device 100 and below the first conveyor belt 94*a*.

Next, the first to third conveyor belts 94*a*, 94*b* and 94*c* will be described in detail. Incidentally, since the first to third conveyor belts 94*a*, 94*b* and 94*c* are similarly configured, they will be referred to collectively as the conveyor belts 94 in the following description.

Figure 2:
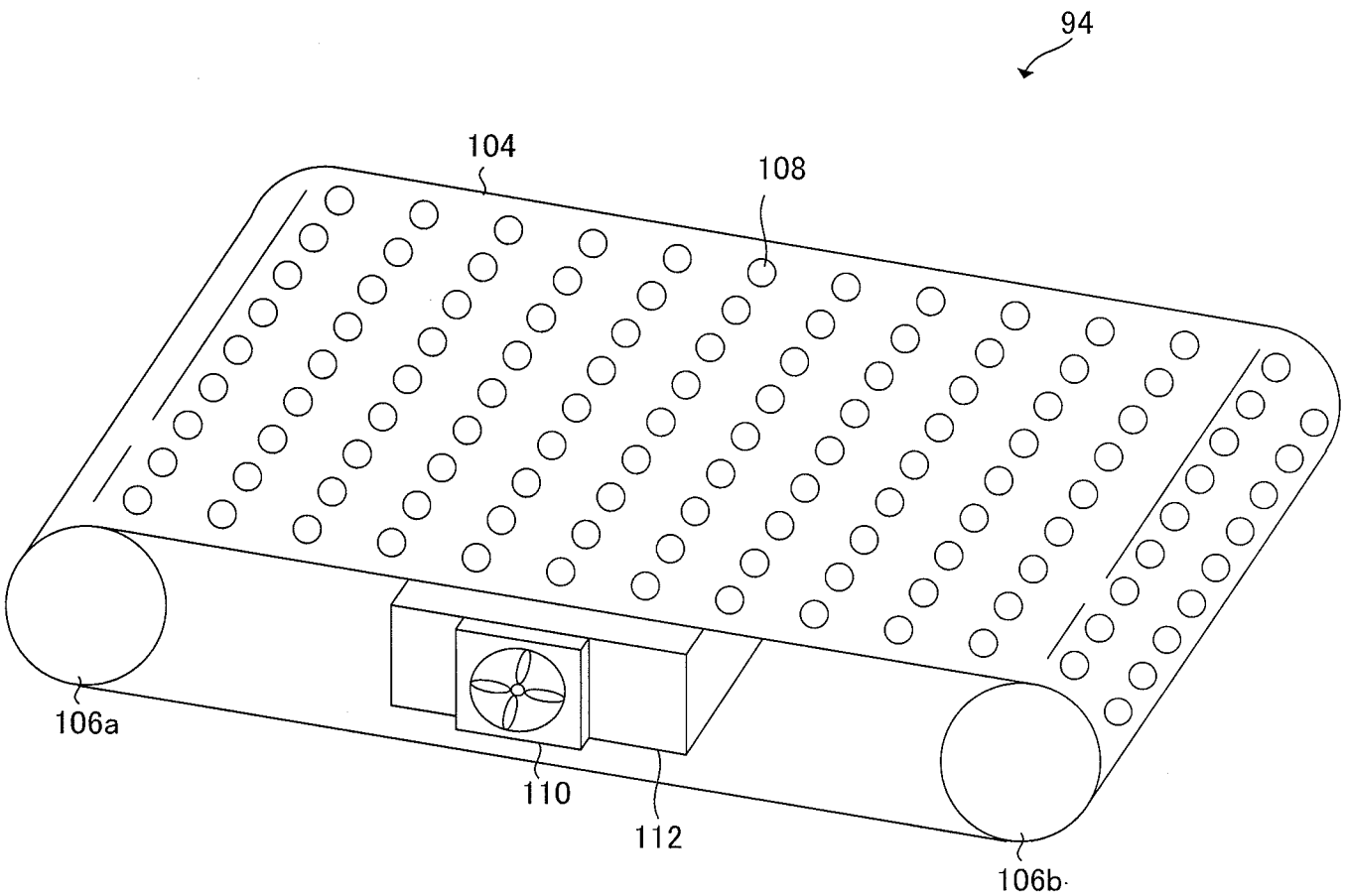
FIG. 2 shows a perspective view of a conveyor belt.

FIG. 2 shows a perspective view of a conveyor belt 94. The conveyor belt 94 has a belt main body 104, and this belt main body 104 is supported by a driving roller 106*a* and a driven roller 106*b*. Following the driving by the driving roller 106*a*, the belt main body 104 rotates.

The belt main body 104 has an air suction hole 108, and an air suction unit 110 and an air suction duct 112 are disposed inside the belt main body 104.

The air suction unit 110 is, for instance, a DC fan, and discharging of air within the air suction duct 112 by this air suction unit 110 brings down the air pressure within this air suction duct 112. When the air pressure within the air suction duct 112 falls, air is sucked through the air suction hole 108 to cause the belt main body 104 to adsorb the recording medium 22.

In this way, the first to third conveyor belts 94*a*, 94*b* and 94*c* adsorb and carry the recording medium 22.

Next, the configuration in the second transferring position will be described in detail.

Figure 3:
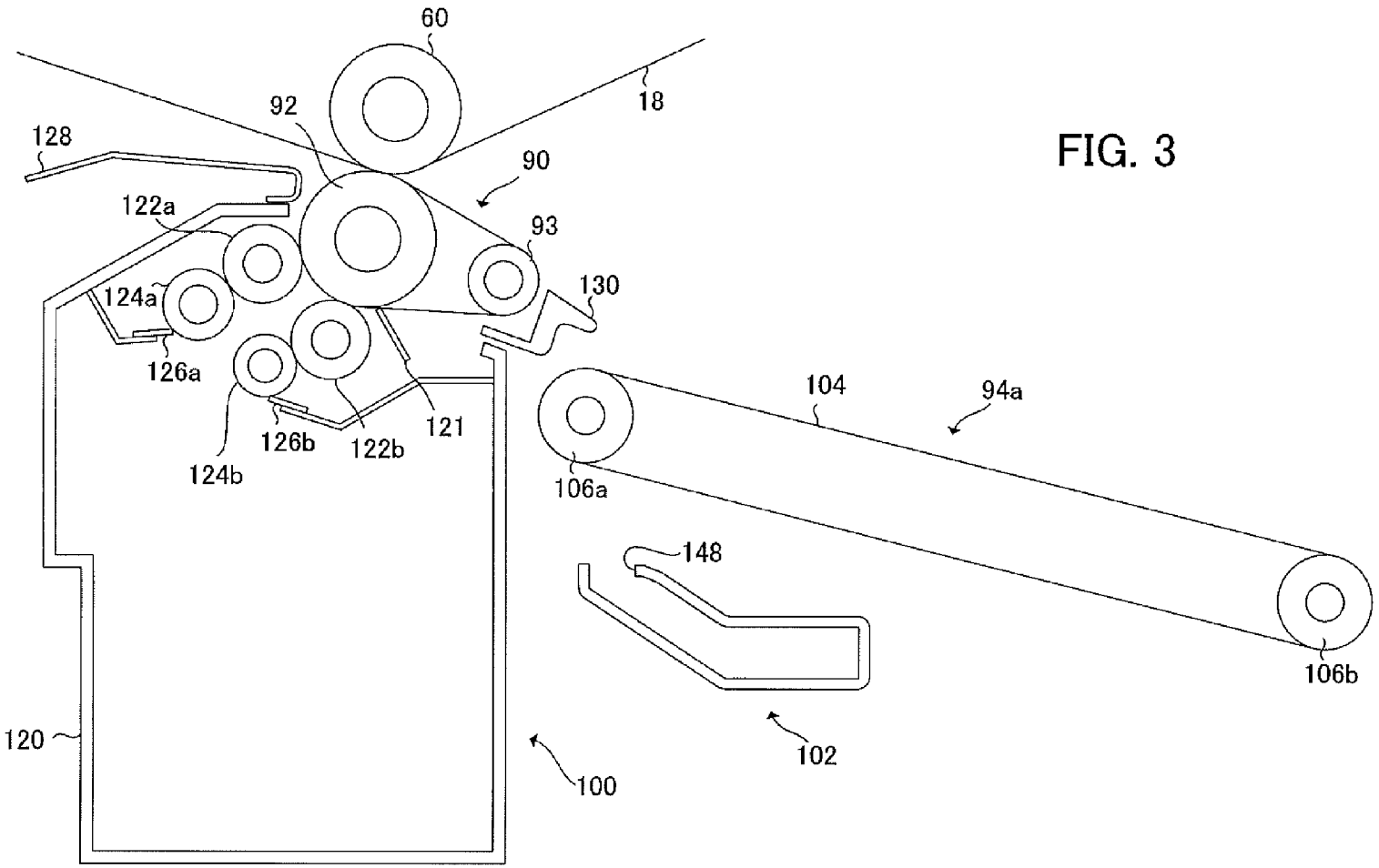
FIG. 3 shows a cross section of a second transfer cleaning device and a structure surrounding the same.

FIG. 3 shows a cross section of the second transfer cleaning device 100 and the structure surrounding the same. The second transfer cleaning device 100 has a collection box 120 as a developer container in which residual toners on the second transfer belt 90 are to be deposited. In the collection box 120, a scraper 121 for scraping off the residual toners on the surface of the second transfer belt 90 is arranged, and cleaning rollers 122*a* and 122*b* arranged in contact with the second transfer belt 90 are rotatably supported.

A voltage of the polarity reverse to the polarity of the electrification of the residual toners on the second transfer belt 90 is applied to the cleaning rollers 122*a* and 122*b*. The configuration is that an electric field in which the residual toners electrostatically shift from the surface of the second transfer belt 90 toward the cleaning rollers 122*a* and 122*b* is generated in this way to remove the residual toners on the second transfer belt 90. Also, discharge products, paper powder and the like having stuck to the second transfer belt 90 are removed by the cleaning rollers 122*a* and 122*b*.

Each of the cleaning rollers 122*a* and 122*b* is configured by forming an elastic layer of a prescribed thickness around a shaft of a prescribed diameter and covering the resultant thermal insulation layer with a textile layer.

The shaft is formed of a metal such as iron or SUS. The elastic layer is formed of, for instance, spongy urethane foam adjusted to a prescribed resistance level by blending electric conductors such as carbon black. Incidentally, the material of the elastic layer is not limited to urethane foam but can as well be appropriately selected out of rubbers such as NBR, SBR and EPDM.

The textile layer is formed of a material formed into a cloth form by knitting electroconductive fibers, a material formed into a cloth form by weaving electroconductive fibers, unwoven cloth formed of electroconductive fibers or the like. The electroconductive fibers may be, for instance, split nylon electroconductive fibers in which carbon black is dispersed. The use of very fine electroconductive fibers serves to increase the surface area of the textile layer, thereby enabling a large quantity of toners to be held and the cleaning performance to be enhanced.

The types of unwoven cloth usable for this purpose include dry unwoven cloth, sponge bands and wet unwoven cloth. Dry unwoven cloth, specifically, is made by forming fibers of a few centimeters in length into thin sheets by carding with an air random machine and stacking a few such sheets as required. Joining of fibers is achieved by entangling them with a pressured fine stream of water.

The cleaning rollers 122*a* and 122*b* are reduced in sliding friction with the surface of the second transfer belt 90 by arranging on the surface of the textile layer made up of soft electroconductive fibers and forming the elastic layer underneath the textile layer.

The cleaning rollers 122*a* and 122*b* have collection rollers 124*a* and 124*b*, arranged in contact with them, for collecting the residual toners removed by these cleaning rollers 122*a* and 122*b*.

To the collection rollers 124*a* and 124*b*, voltages to generate electric fields that shift the residual toners on the surfaces of the cleaning rollers 122*a* and 122*b* toward these collection rollers 124*a* and 124*b* are respectively applied.

The collection rollers 124*a* and 124*b* are rollers of a prescribed external diameter, formed of phenol resin whose resistance level is adjusted by dispersing carbon black. Or they may be made of a metal such as aluminum alloy or stainless steel alloy on whose surface a film of fluorine resin or the like is formed. This serves to smoothen sliding on scrapers 126*a* and 126*b* to be described afterwards. The configuration of the collection rollers 124*a* and 124*b* is not limited to what is described above, but can be selected as appropriate with the system used.

Also, the scrapers 126*a* and 126*b* that scrape off the residual toners having stuck to the surfaces of these collection rollers 124*a* and 124*b* are arranged beside the collection rollers 124*a* and 124*b*.

Each of the scrapers 126*a*, 126*b* and 121 is composed of a plate-shaped member formed of a metal such as iron or stainless steel alloy.

In this way, the toners on the second transfer belt 90 are cleaned by the scrapers 121, 126*a* and 126*b*, the cleaning rollers 122*a* and 122*b*, and the collection rollers 124*a* and 124*b*, and the removed toners are deposited in the collection box 120.

Upstream the second transfer belt 90 in the carrying direction of the recording medium 22, an upstream side connecting part 128 that connects the registration roller 80 and the second transfer belt 90 is arranged, and downstream the same in the carrying direction of the recording medium 22, a downstream side connecting part 130 that connects the second transfer belt 90 and the first conveyor belt 94*a* is arranged.

The sucking device 102 arranged below the first conveyor belt 94 sucks floating matters in the air. The floating matters include toners leaking (scattered) from the second transfer cleaning device 100 and floating (toner cloud) and paper powder. In the following description, toner cloud will be referred to as representative of such floating matters.

Next, the configuration of the sucking device 102 will be described in detail.

Figure 4:
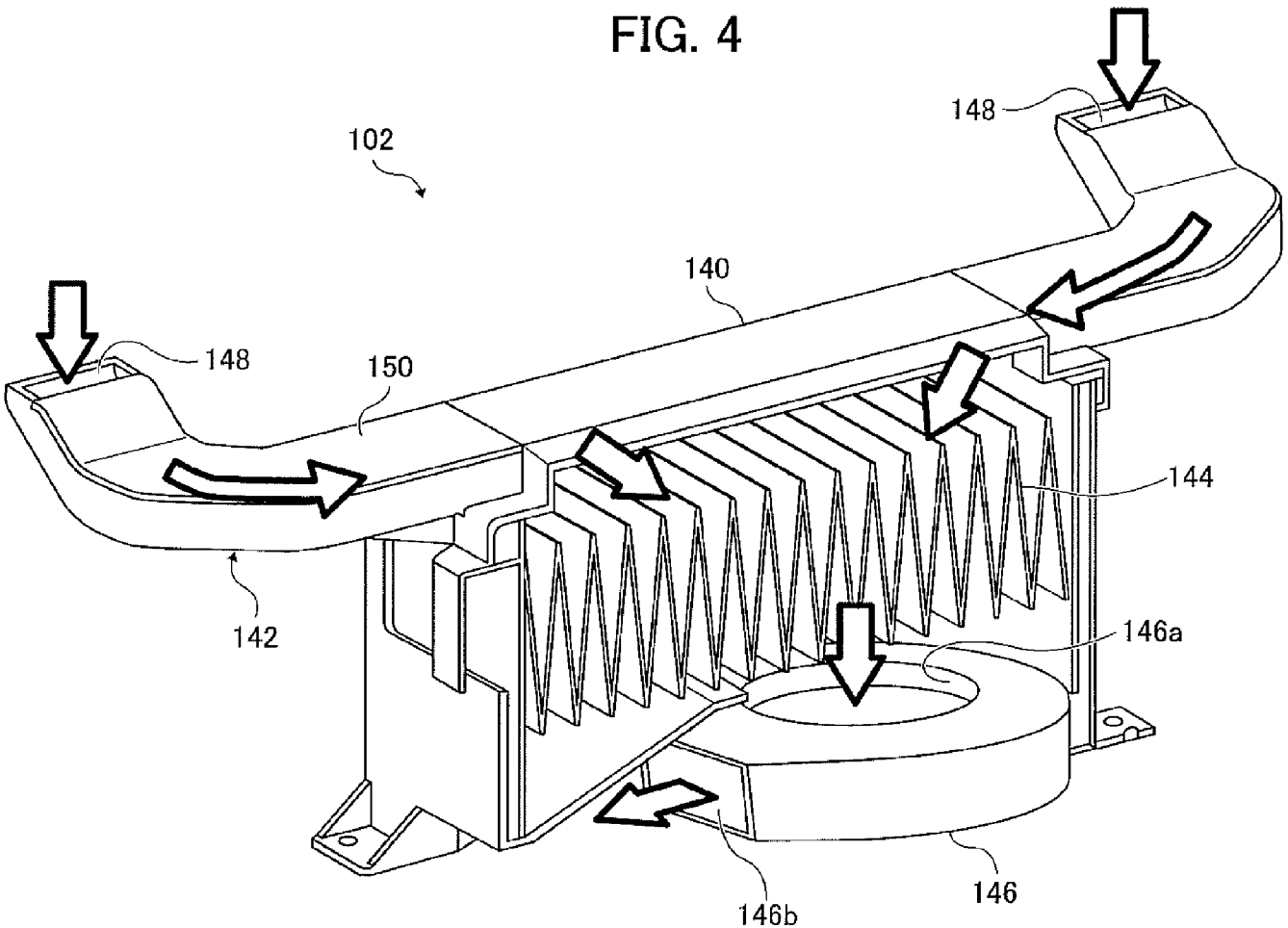
FIG. 4 shows a sectional view of a sucking device.

FIG. 4 shows a sectional view of the sucking device 102. The sucking device 102 includes a sucking device main body 140, a sucking part 142 that takes toner cloud into this sucking device main body 140, a filter 144 of a corrugated shape, for instance, that catches the toner cloud (toners) taken in from the sucking part 142 and a blower 146 that generates a sucking air flow.

The sucking part 142 is provided with multiple (two in this exemplary embodiment) suction inlets 148 through which toner cloud is taken in, and a guiding part 150 that guides the toner cloud taken in through these suction inlets 148 to the filter 144.

The blower 146 is provided with an air intake 146*a* through which air having passed the filter 144 is taken in and an exhaust outlet 146*b* that discharges air taken in through this air intake 146*a*. The air intake 146*a* is disposed on the side opposite the filter 144 (the upper part in FIG. 4), and the exhaust outlet 146*b* is disposed orthogonally to the direction of the air flow from the filter 144 to the air intake 146*a* (in the horizontal direction in FIG. 4).

Therefore, toner cloud, guided by the sucking air flow generated by the blower 146, is taken into the sucking device main body 140 from the suction inlets 148, passes the guiding part 150 and is caught by the filter 144. The air having passed the filter 144 is sucked through the air intake 146*a* of the blower 146 and, with its traveling direction changed, is discharged through the exhaust outlet 146*b* into the image formation device main body 12 (sucked in the perpendicular direction and discharged in the horizontal direction in FIG. 4). By causing the filter 144 to catch the toner cloud and discharging it into the image formation device main body 12, an exhaust unit to discharge it out of the image formation device main body 12 is made unnecessary.

Next, the arrangement of the sucking device 102 will be described in detail.

Figure 5:
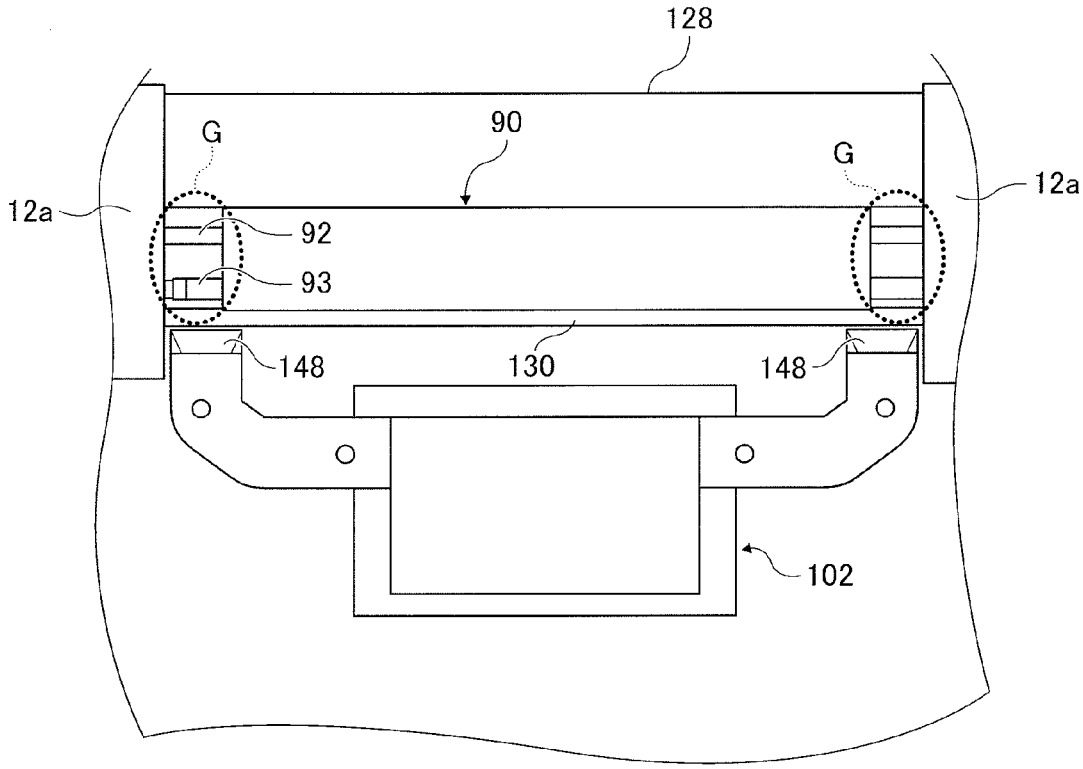
FIG. 5 shows a top view of the second transfer belt, the sucking device and a structure surrounding the same.
Figure 6:
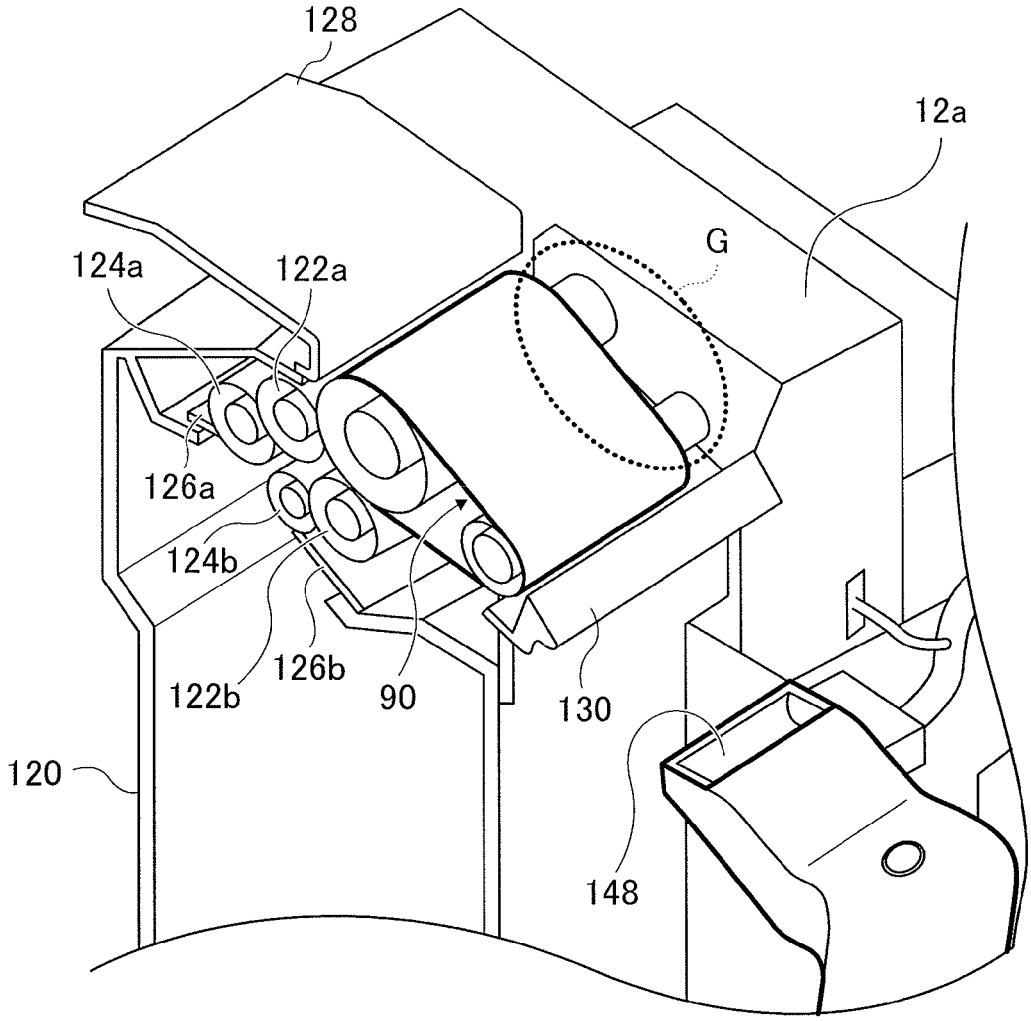
FIG. 6 shows a cross-sectional perspective view of the second transfer belt, the sucking device and a structure surrounding the same.

FIG. 5 shows a top view of the second transfer belt 90, the sucking device 102 and the structure surrounding the same, while FIG. 6 shows a cross-sectional perspective view of the second transfer belt 90, the sucking device 102 and the structure surrounding the same.

The second transfer roller 92 and the driven roller 93 that support the second transfer belt 90 are disposed in supports 12*a* which constitute parts of the image formation device main body 12. Since the second transfer belt 90 rotates here, gaps G are formed between this second transfer belt 90 and the supports 12*a*. For this reason, toner cloud arising from the second transfer cleaning device 100 arranged underneath the second transfer belt 90 (attributable to, for instance, the toners collected into the collection box 120 or the toners scraped off by the scrapers 126*a* and 126*b*) escapes through these gaps G out of the second transfer cleaning device 100 more easily than elsewhere. As a result, toners accumulate in the downstream side connecting part 130 near the gaps G. If the recording medium 22 is carried in this state, the recording medium 22 will be contaminated.

The suction inlets 148 of the sucking device 102 are so arranged as to cause toner cloud to be sucked from below the first conveyor belt 94*a* toward the gaps G. Thus, toner cloud having escaped through the gaps G passes between the second transfer belt 90 (the downstream side connecting part 130) and the first conveyor belt 94*a* and is sucked by the sucking device 102.

For this reason, compared with a case in which the suction inlets 148 are not arranged near the gaps G, toner cloud arising from the second transfer cleaning device 100 is more effectively sucked by the sucking device 102. Therefore, compared with a case in which this configuration is absent, it is more difficult for toner cloud to accumulate in constituent elements of the image formation device main body 12 near the gaps G such as the downstream side connecting part 130, and contamination of the recording medium 22 is thereby prevented.

Further, the configuration is such that the sucking device 102 is arranged below the first conveyor belt 94*a* and toner cloud is sucked in the same direction as the direction in which this first conveyor belt 94*a* (as well as the second conveyor belt 94*b* or the third conveyor belt 94*c*) sucks the recording medium 22 (downward in FIG. 3). Therefore, even when the recording medium 22 is being carried, the sucking device 102 sucks toner cloud without obstructing the carriage of the recording medium 22.

To add, though the foregoing exemplary embodiment is described with respect to the configuration in which the sucking device 102 discharges the air having passed the filter 144 into the image formation device main body 12, this is not the only conceivable configuration, but a discharge unit for discharging the exhaust out of the image formation device main body 12 may as well be provided to be caused to discharge the exhaust out of the image formation device main body 12.

[Second Exemplary Embodiment]

Next, a second exemplary embodiment of the invention will be described.

Figure 7:
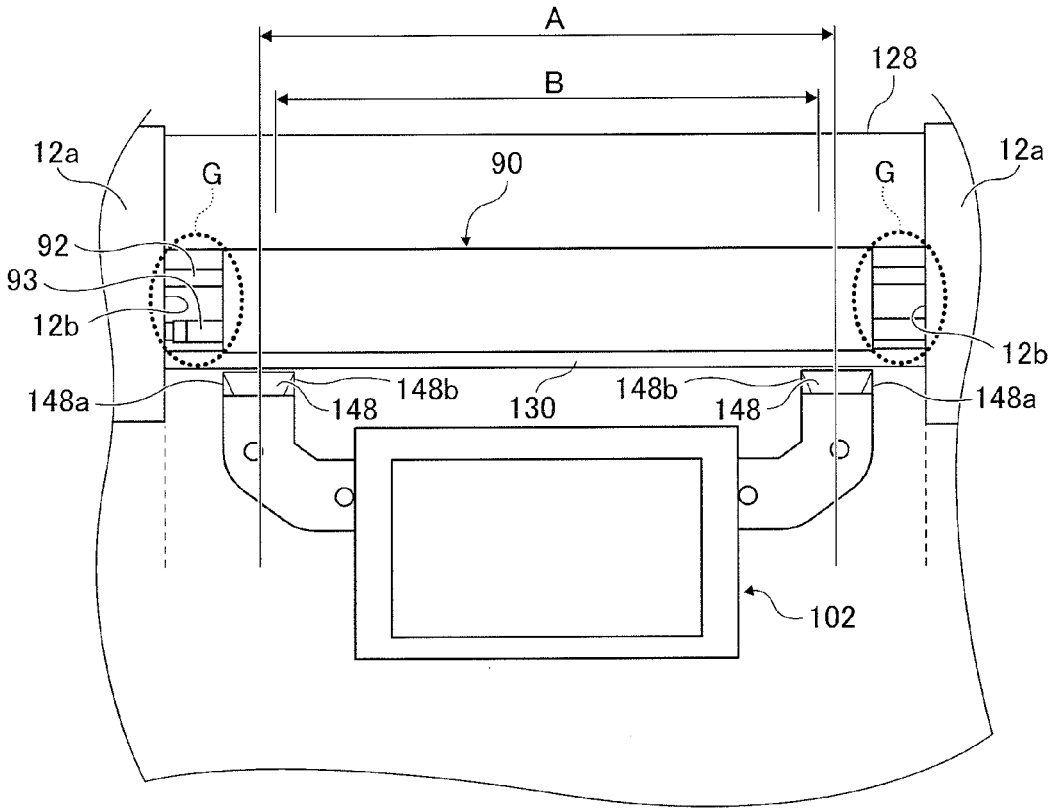
FIG. 7 shows a top view of the second transfer belt, the sucking device and a structure surrounding the same in a second exemplary embodiment of the invention.

FIG. 7 shows a top view of the second transfer belt 90, the sucking device 102 and a structure surrounding the same in the second exemplary embodiment of the invention.

On each of the supports 12*a*, a supporting face 12*b* which is a face that opposes the image formation device main body 12 and on which the second transfer roller 92 and the driven roller 93 are disposed is formed. The supporting faces 12*b* constitute parts of the boundaries forming the gaps G.

An area A represents the width of the recording medium 22 passing the second transfer belt 90. The area A is, for instance, a range in which the recording medium 22 of the maximum width for use in the image formation device 10 passes.

An area B represents the maximum width of image formation.

In the second exemplary mode, the outer edges 148*a* of the suction inlets 148 are arranged, with respect to the axial direction of the second transfer belt 90 (hereinafter sometimes referred to as simply the "axial direction"), farther outside than the area A and farther inside than the supporting face 12*b*.

On the other hand, the inner edges 148*b* of the suction inlets 148 are arranged, with respect to the axial direction, farther inside than the area A. The edges 148*b* may as well be arranged, with respect to the axial direction, farther outside than the area A.

Thus, in this exemplary mode of implementation, the suction inlets 148 are arranged, with respect to the axial direction of the second transfer belt 90, outside the range in which the recording medium 22 passes and a range farther inside than the supporting face 12*b* that overlapping occurs at least partly.

No toner is transferred to the recording medium anywhere farther outside than the area A, and toner cloud is more likely to be generated than in any other part of the second transfer belt 90. For this reason, by arranging the suction inlets 148 as in this configuration, toner cloud can be more efficiently sucked than the case in which this configuration is absent.

[Third Exemplary Embodiment]

Next, a third exemplary embodiment of the invention will be described.

Figure 8:
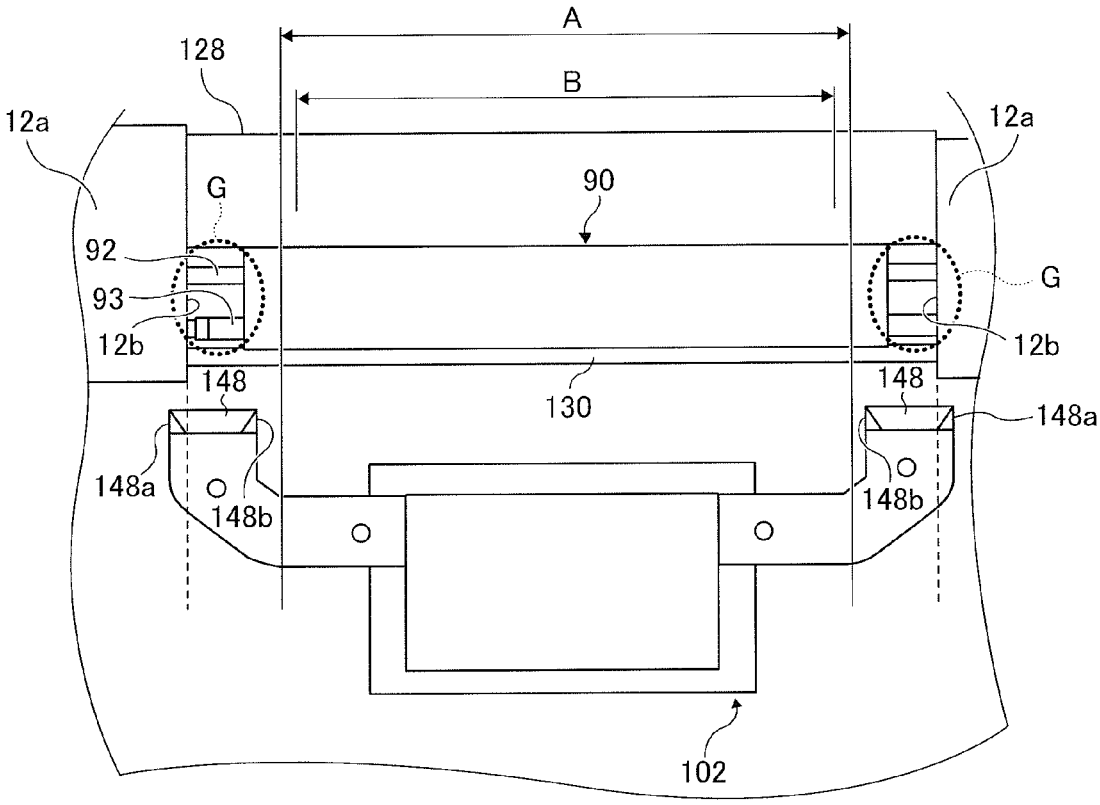
FIG. 8 shows a top view of the second transfer belt, the sucking device and a structure surrounding the same in a third exemplary embodiment of the invention.

FIG. 8 shows a top view of the second transfer belt 90, the sucking device 102 and a structure surrounding the same in the third exemplary embodiment of the invention.

In the third exemplary mode, the outer edges 148*a* of the suction inlets 148 are arranged, with respect to the axial direction, farther outside than the supporting face 12*b*.

On the other hand, the inner edges 148*b* of the suction inlets 148 are arranged, with respect to the axial direction, farther outside than the area A.

Thus in this exemplary mode of implementation, the configuration is such that one end 148*a* of each of the suction inlets 148 is arranged, with respect to the axial direction of the second transfer belt 90, farther outside than the supporting face 12*b*, and the other end 148*b* is farther inside than the supporting face 12*b* and farther outside than the area A.

To add, the end faces 148*b* may as well be arranged, with respect to the axial direction, farther inside than the area A.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation device comprising:

an image carrier that holds developed images;

a transfer body that transfers the developed images held by the image carrier to a recording medium;

a cleaning unit that cleans developer on the transfer body;

a developer container in which the developer removed by the cleaning unit is deposited; and a sucking unit that sucks the developer leaking from the developer container, the transfer body having at least a rotating member of which both ends are rotatably supported, and the sucking unit having a suction hole opening at least at one end of the rotating member.

2. The image formation device according to claim 1, further comprising a transport unit that carries the recording medium to which images have been transferred by the transfer body, wherein the sucking unit is disposed below the transport unit.

3. The image formation device according to claim 1, wherein the sucking unit has a catching part that catches the developer.

4. The image formation device according to claim 2, wherein the sucking unit has a catching part that catches the developer.

5. The image formation device according to claim 1, wherein the transport unit is provided with an adsorbing device that adsorbs the recording medium, and the sucking unit sucks the developer in substantially the same direction as a direction in which the adsorbing device adsorbs the recording medium.

6. The image formation device according to claim 2, wherein the transport unit is provided with an adsorbing device that adsorbs the recording medium, and the sucking unit sucks the developer in substantially the same direction as a direction in which the adsorbing device adsorbs the recording medium.

7. The image formation device according to claim 3, wherein the transport unit is provided with an adsorbing device that adsorbs the recording medium, and the sucking unit sucks the developer in substantially the same direction as a direction in which the adsorbing device adsorbs the recording medium.

8. The image formation device according to claim 1, wherein the sucking unit sucks the developer leaking from the developer container by passing between the transfer body and a transport unit.

9. The image formation device according to claim 2, wherein the sucking unit sucks the developer leaking from the developer container by passing between the transfer body and the transport unit.

10. The image formation device according to claim 3, wherein the sucking unit sucks the developer leaking from the developer container by passing between the transfer body and a transport unit.

11. The image formation device according to claim 4, wherein the sucking unit sucks the developer leaking from the developer container by passing between the transfer body and the transport unit.

12. The image formation device according to claim 1, further comprising supporting faces that rotatably support the rotating member, wherein the suction hole is arranged, with respect to an axial direction of the rotating member, outside a range in which the recording medium of the transfer body passes and farther inside than the supporting faces in a manner in which at least partial overlapping occurs.

13. The image formation device according to claim 2, further comprising supporting faces that rotatably support the rotating member, wherein the suction hole is arranged, with respect to an axial direction of the rotating member, outside a range in which the recording medium of the transfer body passes and farther inside than the supporting faces in a manner in which at least partial overlapping occurs.

14. The image formation device according to claim 3, further comprising supporting faces that rotatably support the rotating member, wherein the suction hole is arranged, with respect to an axial direction of the rotating member, outside a range in which the recording medium of the transfer body passes and farther inside than the supporting faces in a manner in which at least partial overlapping occurs.

15. The image formation device according to claim 4, further comprising supporting faces that rotatably support the rotating member, wherein the suction hole is arranged, with respect to an axial direction of the rotating member, outside a range in which the recording medium of the transfer body passes and farther inside than the supporting faces in a manner in which at least partial overlapping occurs.

16. The image formation device according to claim 5, further comprising supporting faces that rotatably support the rotating member, wherein the suction hole is arranged, with respect to an axial direction of the rotating member, outside a range in which the recording medium of the transfer body passes and farther inside than the supporting faces in a manner in which at least partial overlapping occurs.

17. The image formation device according to claim 1, wherein both ends of the suction hole are arranged, with respect to the axial direction of the rotating member, outside a range in which the recording medium of the transfer body passes and farther inside than supporting faces.

* * * * *